US009360274B2

(12) United States Patent
Horwitz

(10) Patent No.: US 9,360,274 B2
(45) Date of Patent: Jun. 7, 2016

(54) SLING STRAP RETENTION DEVICE

(71) Applicant: Howard Elliot Horwitz, Thousand Oaks, CA (US)

(72) Inventor: Howard Elliot Horwitz, Thousand Oaks, CA (US)

( * ) Notice: Subject to any disclaimer, the term of this patent is extended or adjusted under 35 U.S.C. 154(b) by 81 days.

(21) Appl. No.: 14/258,427

(22) Filed: Apr. 22, 2014

(65) Prior Publication Data

US 2014/0310918 A1 Oct. 23, 2014

Related U.S. Application Data

(60) Provisional application No. 61/814,894, filed on Apr. 23, 2013.

(51) Int. Cl.
*F41C 33/02* (2006.01)
*A44B 18/00* (2006.01)
*F41C 33/00* (2006.01)

(52) U.S. Cl.
CPC ..... *F41C 33/002* (2013.01); *Y10T 24/12* (2015.01)

(58) Field of Classification Search
CPC ..... F41C 33/002; Y10T 24/12
USPC ..... 24/2.5
See application file for complete search history.

(56) References Cited

U.S. PATENT DOCUMENTS 2,576,559 A * 11/1951 Bennek ..... F41C 33/002 224/149
3,947,927 A * 4/1976 Rosenthal ..... A63C 11/025 128/DIG. 15
4,856,149 A * 8/1989 Brame ..... A44C 5/0046 224/220
5,075,934 A * 12/1991 Osedo ..... A44B 18/00 24/16 R
5,081,714 A * 1/1992 Liu ..... B60R 22/001 2/308
5,560,564 A * 10/1996 Maynard ..... B65H 75/04 242/402
5,802,676 A * 9/1998 Tolan ..... A44B 18/00 24/16 PB
6,138,882 A * 10/2000 Buettner ..... A45C 13/00 190/102
6,318,612 B1 * 11/2001 MacNeil ..... B60R 9/048 224/330
6,896,458 B1 * 5/2005 Romero ..... B60P 7/0823 410/100
7,587,796 B1 * 9/2009 Schultz ..... B65D 63/10 24/16 R
2001/0030211 A1 * 10/2001 Keton ..... A45F 5/02 224/222
2003/0102342 A1 * 6/2003 Fogg ..... A45F 5/02 224/269
2003/0150087 A1 * 8/2003 Dieterich ..... A44B 18/0084 24/306
2003/0167605 A1 * 9/2003 Schultz ..... A44B 18/00 24/306
2004/0000570 A1 * 1/2004 Forsman ..... A45F 3/047 224/579
2004/0040125 A1 * 3/2004 Schultz ..... A44B 18/00 24/306
2011/0168747 A1 * 7/2011 Scott ..... F41C 23/02 224/150
2012/0305616 A1 * 12/2012 Smith ..... A45F 3/04 224/614

* cited by examiner

*Primary Examiner* — Robert J Sandy
*Assistant Examiner* — David Upchurch
(74) *Attorney, Agent, or Firm* — Schmeiser, Olsen & Watts LLP

(57) ABSTRACT

A sling strap retention device is provided. The sling strap retention device includes a structure with a first flexible member and a second flexible member, the first flexible member and the second flexible member further comprising a first end and a second end, a first side and a second side, a front surface, and a back surface, wherein the first and second flexible members may be oriented one over the other with the back sides of the first and second flexible members in opposition and coupled along a length of the members. The first and second flexible members may be configured to flex and couple to one another to form opposing closed loops. These closed loops may be configured to couple to and retain therein a sling strap of a weapon.

10 Claims, 5 Drawing Sheets

SLING STRAP RETENTION DEVICE

CROSS REFERENCE TO RELATED APPLICATION

This application claims priority to U.S. Provisional Patent Application to Horwitz entitled "SLING STRAP RETENTION DEVICE," Ser. No. 61/814,894, filed Apr. 23, 2013, the disclosure of which is hereby incorporated entirely herein by reference.

BACKGROUND

1. Technical Field

The following relates generally to sling straps on weapons, and, in particular to a device which can be used together with the sling for safe and efficient weapon storage.

2. State of the Art

Slings may be present on any weapon but are primarily used on long-barrel firearms such as rifles and shotguns. Slings are used, among other things, to carry the weapon while walking or running, and to steady the weapon while aiming and firing.

When a weapon 10 is stored, as depicted in FIG. 1, slings may easily become entangled with other weapons, gear, the storage rack itself, and other nearby objects, creating inconvenience and significant safety hazards. For example, in military and law enforcement situations, tangled slings on stored weapons create difficulty in rapid, safe deployment of these weapons. When pulling the weapon free from its storage configuration, the user may need to stop and physically separate a loose or extra length of sling from the weapon storage rack and/or from various other gear. This may significantly delay deployment of the weapon. Consequently, an entangled weapon sling will place the troop, law enforcement officer or third-party victim(s) in increased danger due to the delay.

With civilian (including but not limited to recreational target shooting and hunting), military, and law enforcement use, entangled slings on stored weapons are a safety hazard. Deployment may dislodge adjacent stored weapons, creating the chance accidental discharge resulting in death or serious injury. At the very least, any loose length of sling 20, as depicted in FIG. 2, may get caught on gear, gun storage racks, etc. and are a nuisance to untangle.

Thus, there is a need in the art for a device that permits the safe and rapid deployment of weapons 10 from side-by-side storage racks, from police vehicles, or from any other storage method for use by military, police, and/or citizens without the sling strap from these weapons 10 becoming entangled with objects or other weapons.

SUMMARY

The following relates to sling straps on weapons, and, in particular to a device which can be used to gather redundant lengths of the sling for safe and efficient weapon storage. The disclosure further relates to a gather for weapon slings that allows for simple, rapid, and reliable deployment of the weapon from various storage configurations, particularly for long-barreled weapons, such as rifles, that are in ubiquitous use throughout the military, various federal and state law enforcement agencies, the civilian population, and amongst recreational users.

An aspect of the present disclosure includes a strap retention device comprising a first portion having a length between opposing ends, a second portion having a length between opposing ends, the first and second portions being functionally coupled to one another between the opposing ends of the first portion and the opposing ends of the second portion, the first portion being configured to releasably couple to itself to form a first bounded region, the first bounded region being configured to releasably engage a portion of the strap therein, the second portion being configured to releasably couple to itself to form a second bounded region, the second bounded region being configured to releasably engage a redundant portion of the strap that has been gathered together.

Another aspect of the present disclosure includes wherein the first portion and second portions are comprised of flexible material.

Another aspect of the present disclosure includes wherein the first portion is comprised of flexible material and the second portion is comprised of elastic material.

Another aspect of the present disclosure includes wherein the respective lengths of the first and second portions are aligned substantially in parallel.

Another aspect of the present disclosure includes wherein the respective lengths of the first and second portions are aligned transversely to one another.

Another aspect of the present disclosure includes wherein the first and second portions further comprise respective fastening mechanisms for facilitating each of the first and second portions coupling to itself Another aspect of the present disclosure includes wherein the first bounded region defines a first axis and the second bounded region defines a second axis, the first and second axes being aligned substantially in parallel.

Another aspect of the present disclosure includes a strap retention system for engaging a sling strap, the system comprising a sling strap defining a length between a first end and a second end, the first end coupled to an object at a first position along the object and the second end coupled to the object at a second position along the object, the length of the sling strap being longer than a length between the first and second positions, the sling strap being configured to be gathered together on itself in a redundant portion, and a plurality of retention devices, each of the retention devices comprising a first portion being configured to releasably couple to itself to form a first bounded region, the first bounded region being configured to functionally engage a portion of the sling strap therein, a second portion being configured to releasably couple to itself to form a second bounded region, the second bounded region being configured to functionally engage the redundant portion of the sling strap, wherein the first and second portions are coupled to one another.

Another aspect of the present disclosure includes wherein the second portion of a first retention device of the plurality of retention devices releasably engages a first end of the redundant portion and the second portion of a second retention device of the plurality of retention devices releasably engages a second end of the redundant portion.

Another aspect of the present disclosure includes wherein force exerted on the sling strap to move the sling strap away from the object causes the respective second portions of the plurality of retention devices to release therefrom the redundant portion.

Another aspect of the present disclosure includes wherein the second portion of a third retention device of the plurality of retention devices releasably engages the redundant portion between the first and second ends of the redundant portion.

Another aspect of the present disclosure includes wherein the plurality of retention devices retain the sling strap substantially taut against the object when the first portions of the respective retention devices functionally engage the sling strap and corresponding second portions of the respective retention devices releasably engage the redundant portion.

Another aspect of the present disclosure includes wherein the first bounded region of each of the plurality of devices is configured to functionally engage the sling strap to substantially prevent the sling strap from axially advancing within the respective first bounded regions.

Another aspect of the present disclosure includes a method of operating a weapon having a sling coupled thereto, the method comprising providing a sling defining a length between a first end and a second end, coupling the first end of the sling to the weapon at a first position along the weapon and the second end of the sling to the weapon at a second position along the weapon, the length of the sling being longer than a length between the first and second positions, gathering redundant portions of the sling together, and binding the redundant portions of the sling to the sling using a retention device, the retention device comprising a first portion releasably coupled to itself to form a first bounded region, the first bounded region functionally engaging a portion of the sling therein, a second portion releasably coupled to itself to form a second bounded region, the second bounded region functionally engaging the redundant portions of the sling, wherein the first and second portions are coupled to one another.

Another aspect of the present disclosure includes storing the weapon after the binding the redundant portions of the sling to the sling.

Another aspect of the present disclosure includes moving the redundant portions of the sling away from the weapon to release the redundant portions from the second bounded region after the binding the redundant portions of the sling to the sling.

To overcome issues caused by loose, excess length of slings of weapons, the sling strap retention device accomplishes five goals: 1) keep the sling flat and neatly organized; 2) allow deployment of the sling instantly; 3) allow the weapon to dock in the lock housing; 4) prevent the sling from hanging up on the lock housing; and 5) allow a plurality of weapons to be stored next to each other without becoming entangled. Accordingly, the sling strap retention device provides a simple, workable solution to these and other problems created by redundant lengths of sling material on weapons.

The sling strap retention device, as disclosed hereafter in this application, may be a structure comprising two overlying flexible members of appropriate length and width, fixedly coupled, whereby the free ends of each member may be detachably coupled to form two adjoining closed loops, one for each flexible member. Moreover, the sling strap retention device, as disclosed hereafter in this application, may be a structure comprising a flexible member of appropriate length and width, fixedly coupled to the sling, whereby the free ends of the member may be detachably coupled to form a closed loop.

The sling strap retention device may be used by attaching the device to the weapon sling, either by encircling a segment of sling material by one of the detachably closed loops or using an alternate method of attachment, such as fixing a single loop to the sling strap. The sling's redundant length is gathered by neatly folding the sling back and forth on itself to take up the slack and secured by the second loop of the sling retention device. This loop keeps the folded sling in place, with the redundant length of sling neatly gathered and secured by the sling strap retention device. One unit may be adequate to secure the sling; alternatively, two or more units of the invention can be used in tandem, as preferred by the user. Because use of the sling strap retention device eliminates the redundant length, the invention greatly reduces the chance of sling entanglement. When the weapon is deployed, a simple tug on the sling releases the gathered material, instantly deploying the sling to its full operational length.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 3:
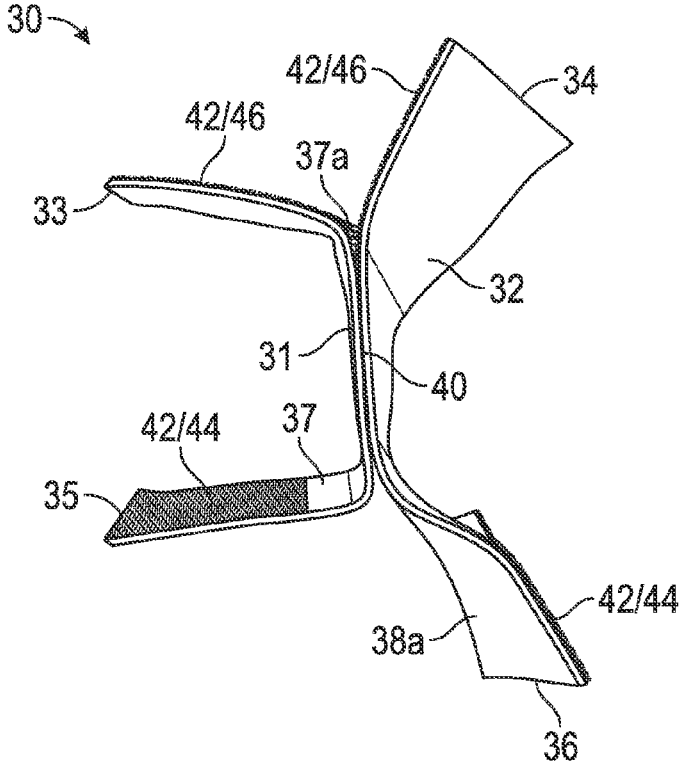
FIG. 3 is a side view of a sling strap retention device in an open position in accordance with the present disclosure.
Figure 4:
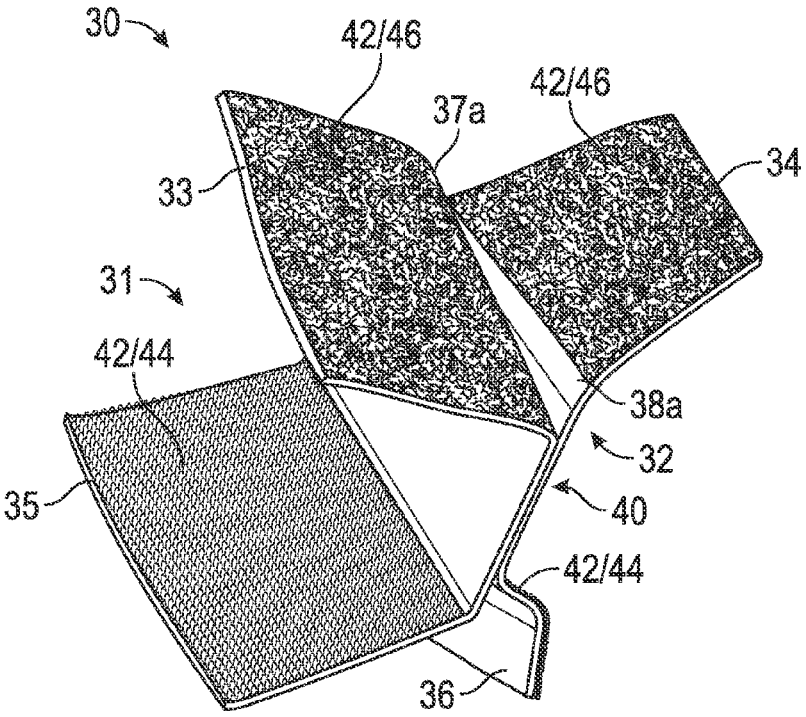
FIG. 4 is a side perspective view of a sling strap retention device in an open position in accordance with the present disclosure.
Figure 5:
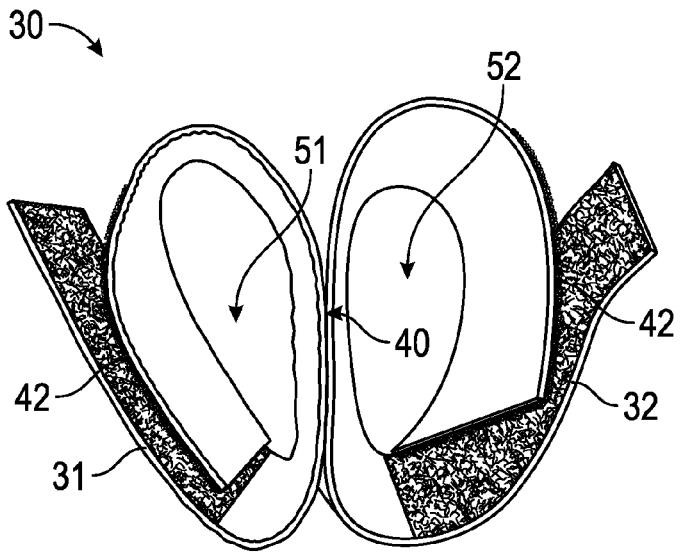
FIG. 5 is a side view of a sling strap retention device in a closed position in accordance with the present disclosure.

Referring to the drawings, FIGS. 3-5 depict an embodiment of a sling strap retention device 30. Embodiments of the sling strap retention device 30 may be utilized to bind redundant portions of a sling strap on a weapon to itself when folded up or gathered up into a reduced length. In addition thereto, embodiments of the sling strap retention device 30 may be utilized to bind redundant portions of a length of material, such as a cord, rope, cable, sling, strap, or other elongate-type object to itself when folded up or gathered up into a reduced length.

Embodiments of the sling strap retention device 30 may comprise portions thereof that may be configured to functionally engage the sling strap in various lengths and configurations as will be described herein. Embodiments of the sling strap retention device may comprise, for example, a first portion 31 and a second portion 32. The first and second portions 31 and 32 may be functionally coupled together so as to oppose one another. In addition, the first and second portions 31 and 32 may each be configured to individually and separately transition between an open position, as depicted in FIG. 3 and a closed position, as depicted in FIG. 5.

Embodiments of the sling strap retention device 30 may further comprise the first portion 31 being a length of flexible material, the flexible material being configured such that the first portion 31 may bend, turn, twist, or otherwise flex, to transition between the open and closed positions. The first portion 31 may be flexible enough to bend, turn, twist, or otherwise flex along its length or width. The first portion 31 may have opposing ends 33 and 35 at opposite ends of the length of the first portion 31. The first portion 31 may have a front surface 37 and a rear surface 37*a* that are defined between opposing ends 33 and 35. The first portion 31 may be comprised of any material that allows the first portion 31 to flex and perform its intended purpose, as described herein. For example, the first portion 31 may be comprised of a textile or other flexible woven material consisting of a network of natural or artificial fibers. Embodiments of the sling retention device 30 may comprise the first portion 31 being comprised of, for example, and not in any way limiting, a textile material, a rubber material, a plastic material, and/or a metal material. Embodiments of the sling retention device 30 may further comprise the first portion 31 being comprised of a textile material that in addition to exhibiting flexible properties and characteristics may also exhibit elastic properties that permit the first portion 31 to stretch when force is applied to the first portion 31 to cause the first portion 31 to displace or stretch. Embodiments of the sling retention device 30 may comprise the first portion 31 being comprised of, for example, and not in any way limiting, a textile material, a rubber material, a plastic material, a metal material, having properties that allow the first portion 31 to bend, flex, twist, and otherwise move, but not necessarily expand in size, as would an elastic material.

Embodiments of the sling retention device 30 may further comprise the first portion 31 having a fastening mechanism 42 coupled thereto. The fastening mechanism 42 may further comprise a coupling component 44 and/or a receiving component 46. The coupling component 44 may be configured proximate the opposing end 35, whereas the receiving component 46 may be configured proximate the opposing end 33. Embodiments of the sling retention device 30 may further comprise the coupling component 44 being configured proximate the opposing end 33, whereas the receiving component 46 may be configured proximate the opposing end 35. At any rate, the coupling component 44 and the receiving component 46 should be configured on the first portion 31 at opposing ends thereof to permit the coupling component 44 and the receiving component 46 to communicate with one another to permit the first portion 31 to releasably and repeatedly couple to itself by way of the coupling component 44 and the receiving component 46. In other words, by utilizing the coupling component 44 and the receiving component 46, the opposing ends 33 and 35 of the first portion 31 may be functionally coupled together and thereafter released, such that the first portion 31 may transition between the open position, as depicted in FIGS. 3 and 4, and the closed position, as depicted in FIG. 5. As depicted, embodiments of the sling retention device 30 may comprise the opposing ends 33 and 35 overlapping one another in the closed position, such that portions of the length of the first portion 31 overlap one another to permit the coupling component 44 and the receiving component 46 of the fastening mechanism 42 to communicate with and engage one another to releasably secure the first portion 31 in the closed position.

Embodiments of the sling retention device 30 may further comprise the second portion 32 being a length of flexible material, the flexible material being configured such that the second portion 32 may bend, turn, twist, or otherwise flex, to transition between the open and closed positions. The second portion 32 may be flexible enough to bend, turn, twist, or otherwise flex along its length or width. The second portion 32 may have opposing ends 34 and 36 at opposite ends of the length of the second portion 32. The second portion 32 may have a front surface 38 and a rear surface 38*a* that are defined between opposing ends 34 and 36. The second portion 32 may be comprised of any material that allows the second portion 32 to flex and perform its intended purpose, as described herein. For example, the second portion 32 may be comprised of a textile or other flexible woven material consisting of a network of natural or artificial fibers. Embodiments of the sling retention device 30 may comprise the second portion 32 being comprised of, for example, and not in any way limiting, a textile material, a rubber material, a plastic material, a metal material. Embodiments of the sling retention device 30 may further comprise the second portion 32 being comprised of a textile material that in addition to exhibiting flexible properties and characteristics may also exhibit elastic properties that permit the second portion 32 to stretch when force is applied to the second portion 32 to cause the second portion 32 to displace or stretch along its length and/or width. Embodiments of the sling retention device 30 may comprise the second portion 32 being comprised of elastic material, with such non-limiting examples thereof being spandex, stretch vinyl, nylon, braided elastic, knitted elastic, and/or woven elastic that allows the second portion 32 to have force applied thereto that results in the second portion 32 being easily stretched or expanded and thereafter resuming its original shape after the applied force is removed.

Embodiments of the sling retention device 30 may further comprise the second portion 32 having a fastening mechanism 42 coupled thereto. The fastening mechanism 42 may further comprise a coupling component 44 and/or a receiving component 46. The coupling component 44 may be configured proximate the opposing end 36, whereas the receiving component 46 may be configured proximate the opposing end 34. Embodiments of the sling retention device 30 may further comprise the coupling component 44 being configured proximate the opposing end 34, whereas the receiving component 46 may be configured proximate the opposing end 36. At any rate, the coupling component 44 and the receiving component 46 should be configured on the second portion 32 at opposing ends thereof to permit the coupling component 44 and the receiving component 46 to communicate with one another to permit the second portion 32 to releasably and repeatedly couple to itself by way of the coupling component 44 and the receiving component 46. In other words, by utilizing the coupling component 44 and the receiving component 46, the opposing ends 34 and 36 of the second portion 32 may be functionally coupled together and thereafter released, such that the second portion 32 may transition between the open position, as depicted in FIGS. 3 and 4, and the closed position, as depicted in FIG. 5. As depicted, embodiments of the sling retention device 30 may comprise the opposing ends 34 and 36 overlapping one another in the closed position, such that portions of the length of the second portion 32 overlap one another to permit the coupling component 44 and the receiving component 46 of the fastening mechanism 42 to communicate with and engage one another to releasably secure the second portion 32 in the closed position.

Embodiments of the sling retention device 30 may further comprise the fastening mechanism 42 being, for example, but not limited to, a hook-and-loop-type fastener, a button-type fastener, an adhesive-type fastener, a zipper-type fastener, a snap-type fastener, a buckle-type fastener, a tie-type fastener, a clip-type fastener, and any other mechanical fastener that allows two or more parts, such as a coupling component 44 and a receiving component 46 to releasably and repeatedly functionally couple to one another.

Embodiments of the sling retention device 30 may further comprise the first portion 31 being a length of flexible material and the second portion 32 being a length of flexible and elastic material. Embodiments of the sling retention device 30 may further comprise the first portion 31 exhibiting less elastic properties and characteristics than the second portion 32, such that the second portion 32 is more elastic and behaves more elastically than the first portion 31. Embodiments of the sling retention device 30 may further comprise the first portion 31 and the second portion 32 having the same length.

Embodiments of the sling retention device 30 may further comprise the first and second portions 31 and 32 being coupled to one another at a section 40 along the respective rear surfaces 37*a* and 38*a*. Embodiments of the sling retention device 30 may further comprise the first portion 31 and the second portion 32 being releasably coupled together. Alternatively, embodiments of the sling retention device 30 may further comprise the first portion 31 and the second portion 32 being fixedly coupled together. As a non-limiting example, the rear surface 37*a* of the first portion 31 may be configured to oppose the rear surface 38*a* of the second portion 32 such that the rear surfaces 37*a* and 38*a* oppose one another. The section 40 may be a point or a larger section of the length of the first and second portions 31 and 32 (but less than the entire length). Thus, at the section 40, the first and second portions 31 and 32 may be coupled to one another. Further, in some embodiments the respective rear surfaces 37*a* and 38*a* may be coupled to one another to secure the first and second portions 31 and 32 to one another. Embodiments of the sling retention device 30 may further comprise the first and second portions 31 and 32 being fixedly coupled to one another at the section 40. However, whether releasably coupled together or fixedly coupled together, the first and second portions 31 and 32 are coupled at the section 40, such that once the first and second portions 31 and 32 are coupled, the first and second portions 31 and 32 are prohibited from completely separating from one another. Further, by being coupled together at the section 40, the remaining uncoupled portions of the first and second portions 31 and 32 are permitted to flex, bend, twist, or otherwise move, such that the fastening mechanism 42 on each of the opposing ends of the first and second portions 31 and 32 may perform its intended purpose and couple the respective opposing ends to one another, as depicted in FIG. 5.

Alternatively, embodiments of the sling retention device 30 may further comprise the first portion 31 and the second portion 32 being comprised of and configured as a unitary piece of material. In other words, the sling retention device 30 may be manufactured as a single piece of material, but yet functions as described herein, with the fastening mechanism 42 on each of the opposing ends of the first and second portions 31 and 32 being able to perform its intended purpose and couple the respective opposing ends of the first and second portions 31 and 32 to one another, as depicted in FIG. 5.

Referring further to FIG. 5, the fastening mechanism 42 on the first portion 31 may be actuated, such that the first portion 31 couples to itself in the closed position to form a first closed loop or a first bounded region that defines therein a space 51, such as a pocket, opening, gap, bore, through hole, or the like. The fastening mechanism 42 may be configured to allow the diameter of the space 51 to adjust to a smaller diameter or a larger diameter, as needed. The space 51 may be configured to receive therein, or otherwise house and temporarily retain, a portion of a sling strap 20 of a weapon 10. Further, the space 51 may be configured to receive therein overlapped portions 22 of the sling strap 20. Under the condition the space 51 retains the overlapped portions 22 of the sling strap 20, the space 51 may be configured to release the overlapped portions 22 upon tension or force being exerted on the overlapped portions 22 or on the sling strap 20, as will be described herein. Further still, the space 51 may be configured to receive and retain therein bundles of overlapped materials, such as for example, and not in any way limiting, cords, hoses, cables, strings, lines, chains, ropes, and any other material that can be overlapped on itself.

Referring still to FIG. 5, the fastening mechanism 42 on the second portion 32 may be actuated, such that the second portion 32 couples to itself in the closed position to form a second closed loop or a second bounded region that defines therein a space 52, such as a pocket, opening, gap, bore, through hole, or the like. The fastening mechanism 42 may be configured to allow the diameter of the space 52 to adjust to a smaller diameter or a larger diameter, as needed. The space 52 may be configured to receive therein, or otherwise house and temporarily retain, a sling strap 20 of a weapon 10. Further, the space 52 may be configured to receive therein overlapped portions 22 of the sling strap 20. Under the condition the space 52 retains the overlapped portions 22 of the sling strap 20, the space 52 may be configured to release the overlapped portions 22 upon tension or force being exerted on the overlapped portions 22 or on the sling strap 20, as will be described herein. Further still, the space 52 may be configured to receive and retain therein bundles of overlapped materials, such as for example, and not in any way limiting, cords, hoses, cables, strings, lines, chains, ropes, and any other material that can be overlapped on itself Embodiments of the sling retention device 30 may further comprise the first bounded region defining a first axis and the second bounded region defining a second axis. Embodiments of the sling retention device 30 may further comprise the first and second axes being aligned substantially in parallel under the condition the first and second portions 31 and 32 are in the closed position.

Embodiments of the sling retention device 30 may further comprise only one of the first and second portions 31 and 32 being present on the device 30, one of the first and second portions 31 or 32 being fixedly coupled directly to the sling strap 20 without the need of the other. In this way, because, for example, the second portion 32 may be fixedly coupled to the sling strap 20, the second portion 32 does not need to be held thereon by the first portion 31. Because of this fixed relationship between the second portion 32 and the sling strap 20, the presence of the first portion 31 may not be needed and the second portion 32 may be actuated to wrap around and enclose portions of the overlapped portions 22 of the sling strap 20 when the second portion 32 is placed in the closed position, as described herein. Alternatively, the first portion 31 may be fixedly coupled to the sling strap 20, such that the first portion 31 does not need to be held thereon by the second portion 32. Indeed, because of this fixed relationship between the first portion 31 and the sling strap 20, the presence of the second portion 32 may not be needed and the first portion 31 may be actuated to wrap around and enclose portions of the overlapped portions 22 of the sling strap 20 when the first portion 31 is placed in the closed position, as described herein.

Figure 1:
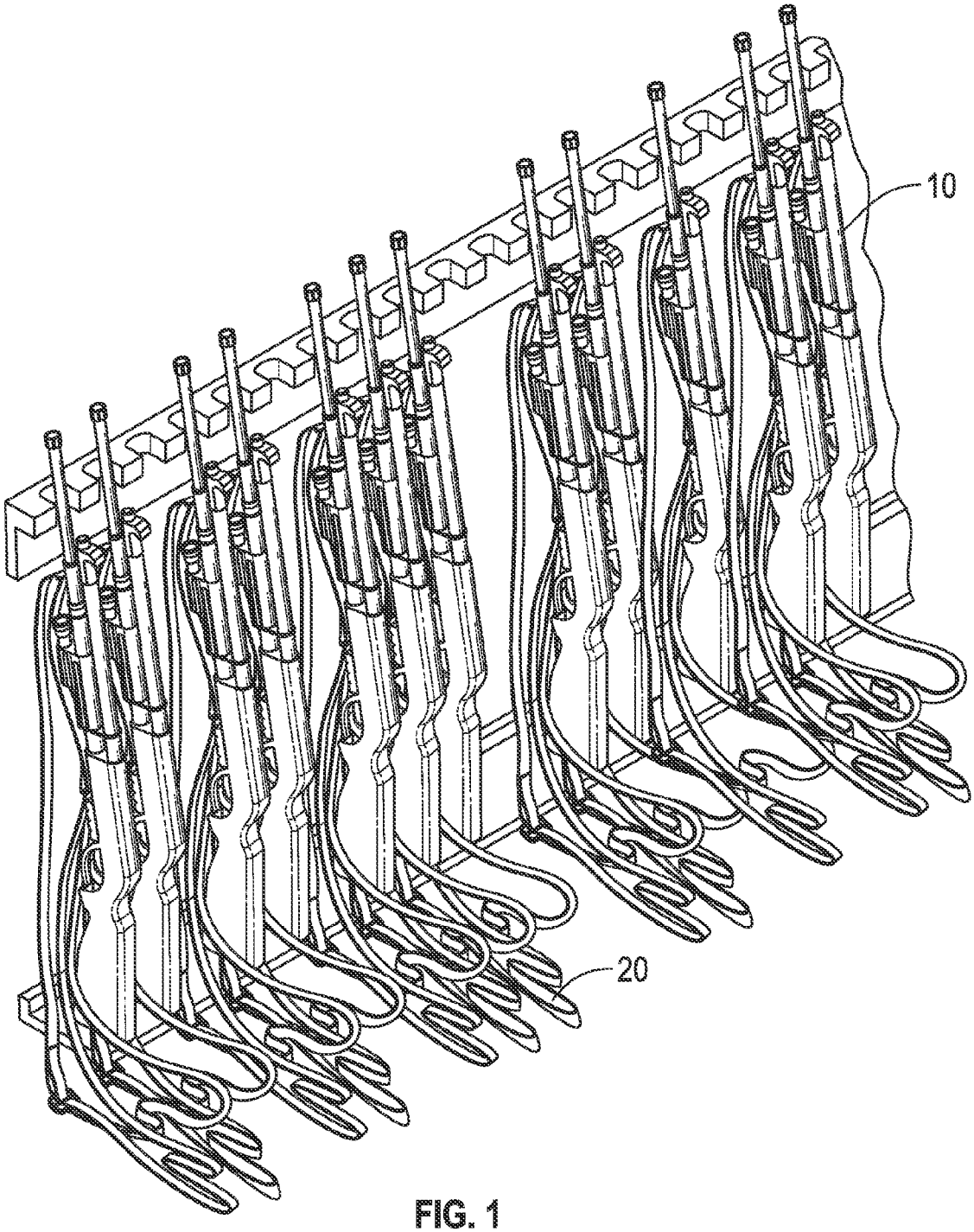
FIG. 1 (Prior Art)
FIG. 1 is a perspective front view of a conventional weapon rack having examples of conventional long-barreled weapons, such as assault rifles, hunting rifles, and shotguns, stored therein.
Figure 2:
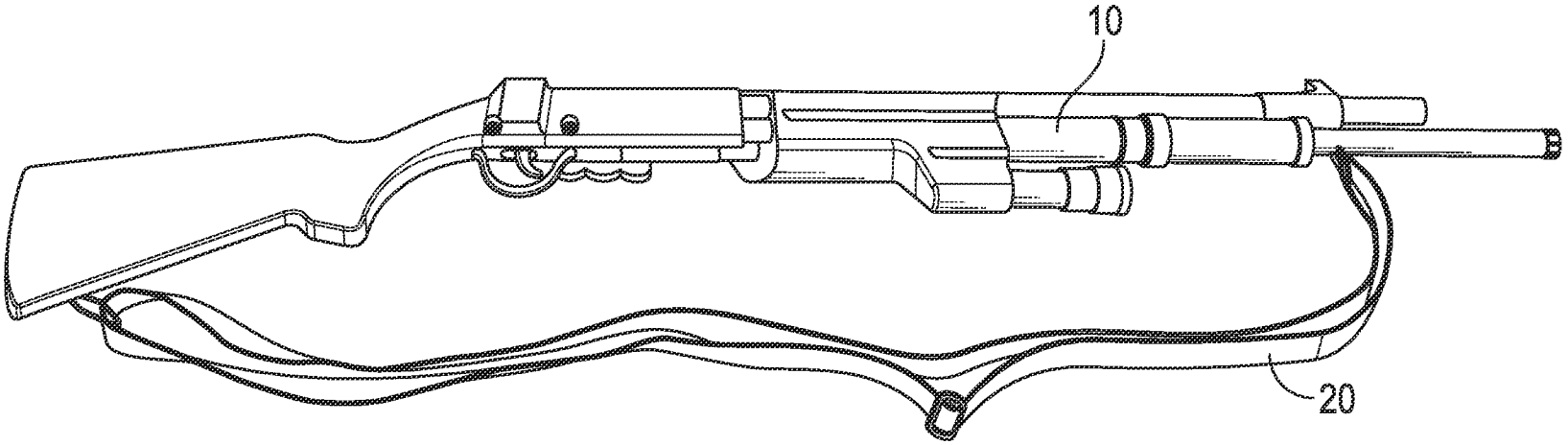
FIG. 2 (Prior Art)
FIG. 2 is a perspective side view of an exemplary conventional long-barreled weapon, such as an assault rifle, a hunting rifle, and a shotgun, having a sling strap attached thereto on opposing ends.
Figure 6:
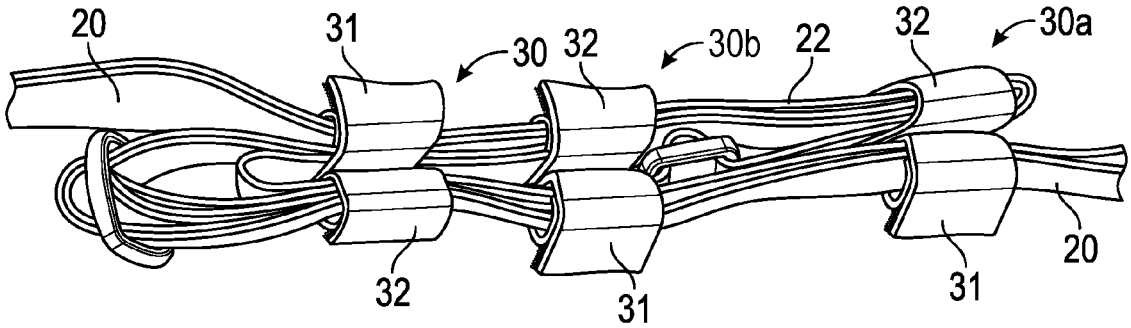
FIG. 6 is a side perspective view of a sling strap retention device in a closed position and engaged with a sling strap in accordance with the present disclosure.
Figure 7:
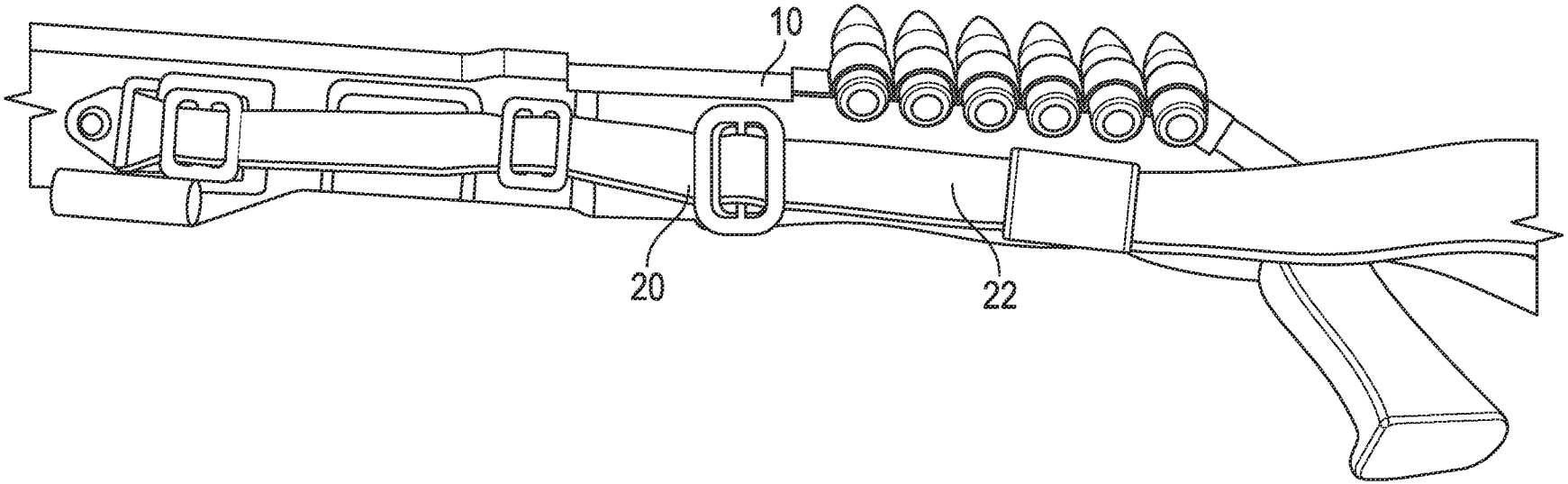
FIG. 7 is a side perspective view of a sling strap retention device in a closed position and engaged with a sling strap on a weapon in accordance with the present disclosure.

Referring now to FIGS. 2 and 6-7, embodiments of the sling strap retention device 30 may be utilized to safely and efficiently secure the overlapped portions 22 of the sling strap 20 to the sling strap 20, or against the sling strap 20, which thereby may safely and securely store, or otherwise retain, the sling strap 20 against the weapon 10 without hindering the normal operation of the weapon 10. Generally, the sling strap 20 is attached to the weapon 10, typically by swivel connectors, at the forward stock or from the underside of a forward part of the gun barrel, and at a second point rearward on the butt stock, as depicted in FIG. 2.

As depicted in FIG. 6, the sling strap 20 may be examined to determine a position on the sling strap 20 that may be selected for placement of the device 30. For example, the first portion 31 may be looped around the sling strap 20 at a desirable location along the sling strap 20. Thereafter, the fastening mechanism 42 on the first portion 31 may be actuated to allow the first portion 31 to couple to itself about the sling strap 20 at the designated and desired position. In this way, the first portion 31 may be configured on the sling strap 20, with the space 51 functionally engaging the sling strap 20. In embodiments of the device 30 where hook and loop fasteners, such as Velcro®-type fasteners, are utilized, the degree of detachability of the first portion 31 from the sling strap 20 can be adjusted by modifying the area of the cooperating Velcro® parts that contact one another, or that overlap one another. In this way, the Velcro® brand hook and loop fastener, or any other fastener of the type described herein that may be adjustable for length, may be similarly used on the first portion 31 to achieve a secure and adjustable, yet easily detachable connection to the sling strap 20.

Once the first portion 31 is functionally engaged with the sling strap 20, the loose portion, redundant portion, and/or slack portion of the sling strap 20 may be gathered up together on itself, such as in folds, rolls, bunches, groups, clusters, or other like gatherings to form the overlapped portions 22 of the sling strap 20. In other words, the loose, redundant, and slack length of the sling strap 20 may be folded back on itself, gathering the redundant material of the sling strap 20 in one or more gathered or stacked loops so that the sling strap 20 is taut between the swivel connectors and lies flat against the weapon 10 or under the weapon 10. The taut sling strap 20 may rest against the side of the weapon 10 opposite the ejection port, so as to not interfere with the normal operation of the weapon 10.

With the sling strap 20 taut, one end of the overlapped portions 22 may be gathered and placed in proximity with the second portion 32. Thereafter, the second portion 32 may be actuated, such that the second portion 32 may be looped around the overlapped portions 22 of the sling strap 20. Thereafter, the fastening mechanism 42 on the second portion 32 may be actuated to allow the second portion 32 to couple to itself about the overlapped portions 22. In this way, the second portion 32 may be configured on the overlapped portions 22, with the space 52 functionally engaging the overlapped portions 22. In embodiments of the device 30 where hook and loop fasteners, such as Velcro®-type fasteners, are utilized, the degree of detachability can be adjusted by modifying the area of the cooperating Velcro® parts that contact one another, or that overlap one another. In this way, the Velcro® brand hook and loop fastener, or any other fastener of the type described herein that may be adjustable for length, may be similarly used on the second portion 32 to achieve a secure and adjustable, yet easily detachable connection.

As depicted in FIG. 6, embodiments of the sling strap retention device 30 may further comprise a plurality of sling strap retention devices 30 being utilized in a system to secure the opposing ends of the overlapped portions 22 to respective locations along the length of the sling strap 20. Consider that when loose sections of a sling strap 20 are gathered up on themselves in stacked loops, these stacked loops will usually have opposing ends. As a result, embodiments of the sling strap retention device 30 may comprise using a plurality of sling strap retention devices 30 and **30*a* in a fastening system to secure each opposing end of the overlapped portions 22 individually to the sling strap 20. For example, the sling strap retention device 30 may be utilized to couple one end of the opposing ends of the overlapping portions 22 to the sling strap 20. Likewise, a second sling strap retention device 30*a* may be utilized to couple the second end of the opposing ends of the overlapping portions 22 to the sling strap 20. A third sling strap retention device 30*b* may also be used. In particular, but not in any way limiting, the first portion 31 of the first device 30 may be operated to functionally engage the sling strap 20, as described above, such that the first portion 31 of the first device 30 is functionally secured to the sling strap 20. Thereafter, the second portion 32 of the first device 30 may be operated to functionally engage a portion of the overlapped portions 22 of the sling strap 20, as described above. Likewise, the first portion 31 of the second device 30*a* may be operated to functionally engage the sling strap 20, as described above, such that the first portion 31 of the second device 30*a* is functionally secured to the sling strap 20. In addition, the second portion 32 of the second device 30*a* may be operated to functionally engage another portion of the overlapped portions 22 of the sling strap 20, as described above. In this way, at least each end of the overlapped portions 22 may be functionally secured to the sling strap 20 by one or more devices 30 and 30*a*, such that the sling strap 20 is taut against the weapon 10, as depicted in FIG. 7. Embodiments of the sling strap retention device 30 may further comprise more than two devices 30 and 30*a* being utilized to secure the overlapped portions 22 to the sling strap 20** for added security.

Embodiments of the sling strap retention device 30 may further comprise a user adjusting and determining the diameter of the closed loop or bounded region, or spaces 51 and 52, of each of the first and second portions 31 and 32, the respective diameters being determined according to a width of the sling strap 20 of the weapon 10 and the total thickness of the overlapped portions 22 to be secured, respectively. For example, the user-adjusted diameter of the closed loop or bounded region, or spaces 51 and 52, formed by the first and second portions 31 and 32, respectively, are an important feature of the device 30. For example, the space 51 defined by the first portion 31 should be configured to engage the sling strap 20 such that the sling strap 20 does not freely transition back and forth within the space 51. Indeed, the space 51 should be configured to have a diameter that engages and retains therein the sling strap 20 such that it does not freely move but remains in place. On the other hand, the space 52 defined by the second portion 32 should be snug enough to adequately secure the overlapped portions 22 during storage, so the sling strap 20 does not inadvertently come loose, but yet should be loose enough to allow for quick and easy release of the overlapped portions 22 from the space 52 during deployment of the weapon 10 and as desired by the user.

For example, with the sling strap 20 and the overlapped portions 22 secured by one or more devices 30, as disclosed above and depicted in FIG. 7, the weapon 10 may operate normally. In other words, if undesired, the sling strap 20 need never be deployed from engagement by the retention devices 30 and/or 30*a*. When, however, under the condition the user wishes to deploy the sling strap 20, the user may access the full use of the sling strap 20 by a few simple motions. First, the user need only place the user's non-trigger hand, or "off hand," between the weapon 10 and the sling 20. Second, with the "off hand" the user may push, or otherwise move, the sling strap 20 away from the weapon 10. This force applied by the user to move the sling strap 20 away from the weapon 10 results in the overlapped portions 22 of the sling strap 20 easily and quickly pulling through the spaces 52 defined by the respective second portions 32 to allow the sling strap 20 to deploy to its full length. In these circumstances, the first and second portions 31 and 32 do not decouple from one another, nor does the first portion 31 decouple from the sling strap 20. Instead, the overlapped portions 22 simply pull out of the spaces 52 defined by the second portions 32, such that the sling strap 20 deploys to its full length. Once deployed to the full length, the user may keep the sling strap 20 outstretched against the back of the "off hand" and simply flip the sling strap 20 over the user's head and shoulder in one fluid motion. In this way, the sling strap retention device 30 facilitates a simple, natural, and efficient immediate transition of the sling strap 20 from a stored configuration to a fully deployed configuration whereby the user of the weapon 10 may aim and fire the weapon 10 in short order and without having to untangle the weapon 10 from other weapons or objects because of a tangled sling strap.

As mentioned above, the second portion 32 may be comprised of a flexible and elastic material. With the second portion 32 exhibiting flexible and elastic properties, the overlapped portions 22 more readily release from the space 52, thus facilitating the deployment of the sling strap 20 discussed above. Further, the first portion may be comprised of a flexible, but non-elastic material. With the first portion 31 exhibiting flexible, but inelastic properties, the space 51 more effectively engages the sling strap 20 such that the first portion 31, and thus the entire device 30, does not improperly shift up and down the sling strap 20 once configured thereon.

Moreover, once the user has finished with the weapon 10, the sling strap 20 may be gathered, as described above, to create the overlapped portions 22. The device 30 or devices 30 and 30*a* may then be reutilized to safely and efficiently secure the sling strap 20 to the weapon 10, until the weapon 10 is again needed. With the sling strap 20 taut against the weapon 10, the sling strap 20 is prohibited from becoming entangled on adjacent weapons 10, on other sling straps 20, or on any other undesired object.

Embodiments of the sling strap retention device 30 may further comprise a method of operating a weapon, such as for example, a rifle, shotgun, or other weapon that may utilize a sling strap for portability or storage. The method may comprise providing a sling strap on a weapon. The sling strap may have an original length defined between two opposing ends, with each end being attached to the weapon at different positions on the weapon, the original length of the strap being longer than the length between the positions at which the strap is connected to the weapon. The method may further comprise coupling a retention device to the sling strap. The retention device may be a retention device 30, as described above, and the retention device 30 may be coupled to the sling strap 20 as described above. The method may further comprise folding the sling strap on itself to reduce the length of the sling strap and bring the sling strap up against the weapon, such that the folded length of the sling strap is substantially the same as the length between the positions at which the strap is connected to the weapon. Folding the sling strap on itself may comprise one or more folds in a stacked fold configuration. The method may further comprise utilizing the retention device to releasably secure the stacked fold to the sling strap. The method may further comprise moving the stacked fold away from the weapon. Moving the stacked fold away from the weapon can release the stacked fold from the retention device to permit the sling strap to return to its original length. The method may further comprise storing the weapon with the retention device engaging the stacked fold to maintain the sling strap taut against the weapon. The method may further comprise deploying the weapon from storage by gripping the weapon with one hand and moving the stacked fold away from the weapon with the other hand to release the stacked fold from the retention device to permit the sling strap to return to its original length.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A strap retention system for engaging a sling strap, the system comprising:

a sling strap defining a length between a first end and a second end, the first end coupled to an object at a first position along the object and the second end coupled to the object at a second position along the object, the length of the sling strap being longer than a length between the first and second positions, the sling strap being configured to be gathered together on itself in a redundant portion; and a plurality of retention devices, each of the retention devices comprising:

a first portion being configured to releasably couple to itself to form a first bounded region, wherein the first bounded region engages a portion of the sling strap therein;

a second portion being configured to releasably couple to itself to form a second bounded region, wherein the second bounded region engages the redundant portion of the sling strap, wherein the first and second portions are coupled to one another; and wherein the first portion and the second portion each have a front surface and a rear surface.

2. The system of claim 1, wherein the second portion of a first retention device of the plurality of retention devices releasably engages a first end of the redundant portion and the second portion of a second retention device of the plurality of retention devices releasably engages a second end of the redundant portion.

3. The system of claim 1, wherein force exerted on the sling strap to move the sling strap away from the object causes the respective second portions of the plurality of retention devices to release therefrom the redundant portion.

4. The system of claim 2, wherein the second portion of a third retention device of the plurality of retention devices releasably engages the redundant portion between the first and second ends of the redundant portion.

5. The system of claim 1, wherein the first portion and second portions are comprised of flexible material.

6. The system of claim 1, wherein the first portion is comprised of flexible material and the second portion is comprised of elastic material.

7. The system of claim 1, wherein the first and second portions further comprise respective fastening mechanisms for facilitating each of the first and second portions coupling to itself.

8. The system of claim 1, wherein the first bounded region defines a first axis and the second bounded region defines a second axis, the first and second axes being aligned substantially in parallel.

9. The system of claim 1, wherein the plurality of retention devices retain the sling strap substantially taut against the object when the first portions of the respective retention devices functionally engage the sling strap and corresponding second portions of the respective retention devices releasably engage the redundant portion.

10. The system of claim 1, wherein the first bounded region of each of the plurality of devices is configured to the sling strap to substantially prevent the sling strap from axially advancing within the respective first bounded regions.

* * * * *